US008690635B1

(12) United States Patent
Calvert

(10) Patent No.: US 8,690,635 B1
(45) Date of Patent: Apr. 8, 2014

(54) BREAST PLATFORM SYSTEM

(71) Applicant: VH Associates, Trustee for Breast Platform System CRT Trust, Manassas, VA (US)

(72) Inventor: S. Mill Calvert, Manassas, VA (US)

(73) Assignee: VH Associates, Trustee for Breast Platform System CRT Trust, Manassas, VA (US)

( * ) Notice: Subject to any disclaimer, the term of this patent is extended or adjusted under 35 U.S.C. 154(b) by 0 days.

(21) Appl. No.: 14/081,729

(22) Filed: Nov. 15, 2013

(51) Int. Cl.
*A41C 3/00* (2006.01)

(52) U.S. Cl.
CPC ..... *A41C 3/0021* (2013.01)
USPC ..... 450/53; 450/60

(58) Field of Classification Search
USPC ..... 450/54–58, 60, 53; 2/267, 268
See application file for complete search history.

(56) References Cited

U.S. PATENT DOCUMENTS

| | | | | |
|---|---|---|---|---|
| 2,728,079 | A | 12/1955 | Williams | |
| 3,280,818 | A | 10/1966 | Pankey et al. | |
| 3,503,404 | A * | 3/1970 | Evers | 450/39 |
| 3,934,593 | A | 1/1976 | Mellinger | |
| 4,245,644 | A * | 1/1981 | Evans | 450/52 |
| 4,295,469 | A * | 10/1981 | Lindgren | 450/56 |
| 4,816,004 | A * | 3/1989 | Emanuel | 450/55 |
| 6,402,585 | B1 * | 6/2002 | Gatto et al. | 450/53 |
| 6,406,353 | B1 * | 6/2002 | Harper | 450/57 |
| 7,056,187 | B2 * | 6/2006 | Cassity | 450/88 |
| 7,077,719 | B2 * | 7/2006 | Shiekman | 450/1 |
| D666,386 | S | 9/2012 | Deal et al. | |

* cited by examiner

*Primary Examiner* — Gloria Hale
(74) *Attorney, Agent, or Firm* — Louis Ventre, Jr.

(57) ABSTRACT

An L-shaped platform system for female breasts has a vertical leg and a horizontal leg for each breast, and a strap that holds the legs in place. The vertical leg rests against the torso under a human breast. The horizontal leg extends outward from the torso under the human breast supporting it against the pull of gravity. The strap may have two free ends that fit around the human body and attach together like a bra. Each vertical leg may be embedded within the strap so as to fix the position of each L-shaped platform on the strap. Alternatively, the vertical legs have slots that permit weaving the strap through the vertical leg and permitting adjustment of the position of the L-shaped platform. A spring hinge may be added to join the horizontal leg to the vertical leg so that the horizontal leg can pivot downward.

7 Claims, 2 Drawing Sheets

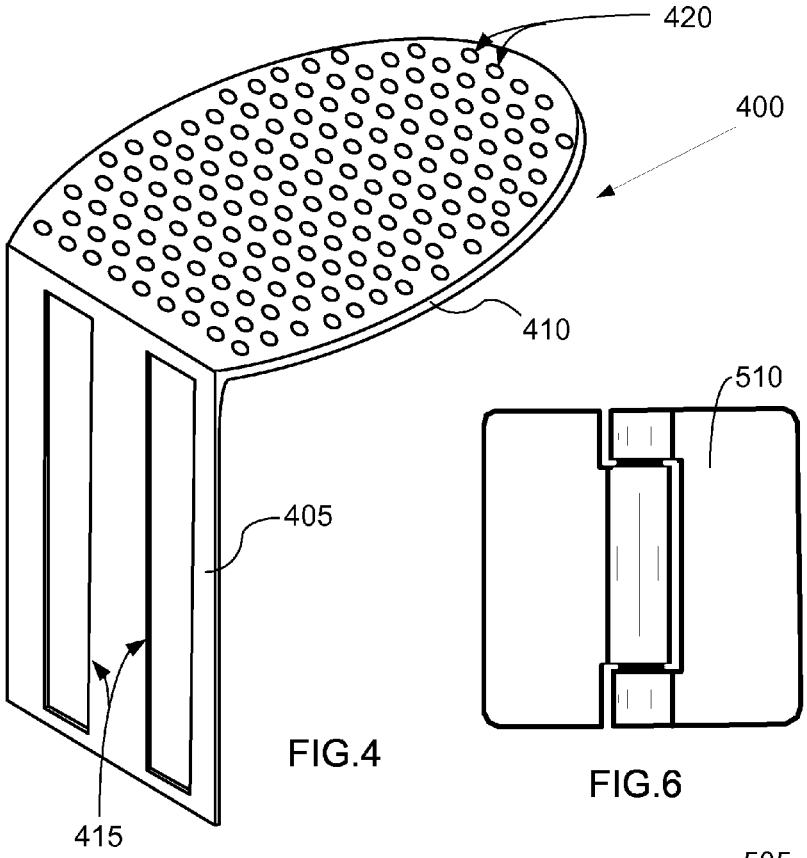
FIG.4
FIG.6
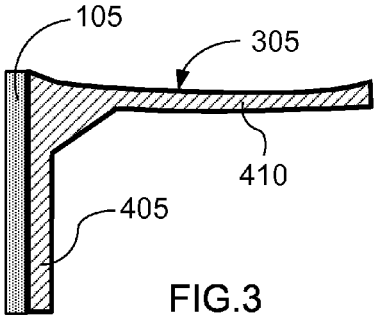
FIG.3
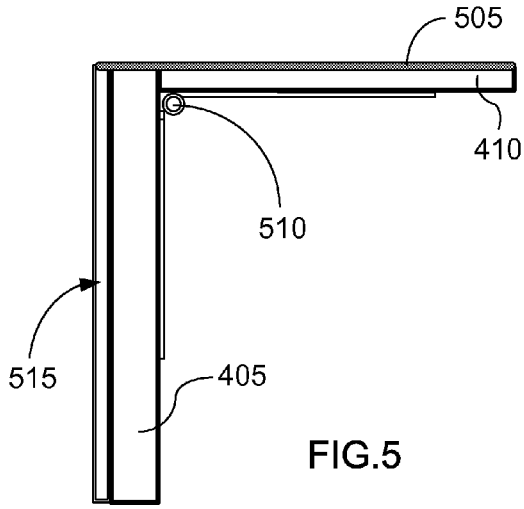
FIG.5

BREAST PLATFORM SYSTEM

TECHNICAL FIELD

In the field of foundation garments, a structural platform to be applied to the upper part of the torso to contact and support the breasts of the human body to prevent the shape altering effects of gravity thereon.

BACKGROUND ART

Ptosis, or sagging of a female's breasts, is a natural consequence of gravity, weight gain and the aging process. It is most pronounced when the nipples extend below the point at which the underside of the breasts attach to the chest wall. Youthful, smaller breasts have a perceptively firm shape with a nipple that points outward. The most severe sagging breasts have nipples that point toward the ground.

The connective tissue that supports the breasts and provides structural integrity is known as Cooper's ligaments (also known as the suspensory ligaments of Cooper and the fibrocollagenous septa). Cooper's ligaments serve to divide the breast into compartments.

Because a woman's breasts grow in size during pregnancy, ligaments are stretched and gradually lose strength. The elastin in the skin also breaks down with smoking and other environmental effects and this alters reduces the firm appearance of the breasts.

Sagging is also affected by being overweight or repeated weight gains and losses. Generally, when the ligaments lengthen, the internal support of the breast weakens and the breast tissue sags under its own weight, losing its youthful firmness and contour.

Generally, sagging has been addressed by wearing a brassiere to physically prevent the appearance of the breasts from having a sagging appearance under clothing. Bra manufacturers typically advertise the ability to restore the shapely appearance of a woman's breasts at least while wearing their bra. However, compacting the breast with a bra may have adverse health consequences and studies have been published showing that wearing a bra may have an overall negative effect on sagging breasts.

SUMMARY OF INVENTION

A breast platform system for a human body having an L-shaped platform for each breast. Each L-shaped platform has a vertical leg and a horizontal leg. The vertical leg rests against the human body under a human breast. The horizontal leg extends outward from the human body under the human breast supporting it against the pull of gravity. A strap engages each L-shaped platform holding them in place. The strap has two free ends that fit around the human body, like a bra. The ends may be joined with an attachment mechanism to secure the strap and the L-shaped platforms in place. Each vertical leg may be embedded within the strap so as to fix the position of each L-shaped platform on the strap. Alternatively, the vertical legs have slots that permit weaving the strap through the vertical leg and permitting adjustment of the position of the L-shaped platform. The horizontal and vertical legs of the L-shaped platforms may be contoured to conform to the body and the breasts. A cushion may be added to the top surface of the horizontal leg for comfort. The horizontal leg may also have holes therethrough to promote cooling. A spring hinge may be added to join the horizontal leg to the vertical leg so that the horizontal leg can pivot downward.

Technical Problem

There is a need for a breast structural support that restores the youthful appearance of the breasts with the nipples pointing outward, but does not compact and confine the breasts.

Women come in all different shapes and sizes and their breasts and breast tissue also come in all different shapes and sizes. Many times and for many different reasons, women desire not to wear a bra, but they are still concerned about not having any support for their breasts. They know that the constant downward pressure from gravity and other dynamic activities, such as movement and exercise can, over a period of time, stretch out their skin, connective tissue, glandular tissue, and suspensory ligaments, which can contribute to ptosis. The worst example of this is grade IV ptosis, where the nipple is far below the inframamary fold and points to the floor.

Some of the reasons that women desire not to wear a bra are as follows: they feel strapped in and constrained by the bra; they want to wear clothing that the bra or bra straps interfere with; they are breast feeding their new baby; they don't like the unnatural shape the bra compresses the breasts into; they don't like the severe restriction on natural breast movement that the bra imposes; they don't like the excess heat that the bra cup concentrates on the breast tissue; they don't like the pressure against their breast; they don't like to have their nipples covered with the bra cup; they don't like the chore of always having to put on and take off the bra; they don't like the fact that the expectation of strapping yourself into a restrictive bra is imposed on them by a man's culture; they like to exercise without a constraining bra; and they just want to relax and be comfortable without the slayery of the uncomfortable bra.

For whatever reason that women decide not to wear a bra, they have always been concerned about the lack of support and the downward pressure against the breasts.

Solution to Problem

The solution is a breast platform system that supports the breasts against gravity with an L-shaped platform strapped in place around the torso.

The breast platform system works by having a flat, contoured or soft cushioned platform on the underside of each breast. This comfort platform will support against downward pressure, so the breast tissue and ligaments are not constantly stretched down. The breasts are not covered or re-shaped or constrained like a bra would do, and they are fee to move around in their own natural healthy movement. The comfort platform may also have air flow circulation holes so heat is not insulated by the comfort platforms, but is distributed by air flow against the chest area far below the breasts. The breast platform system can come in all different shapes and sizes to accommodate the different sizes that women have. The breast platform system can also come with sliding adjustable comfort platforms that can be spring loaded and folded down flat if no downward support is desired for a period of time.

Advantageous Effects of Invention

The breast platform system supports the breasts so that the nipple is outwardly pointing giving a youthful appearance.

The breast platform system supports the breasts but without inwardly compressing and confining them.

The breast platform system permits more natural breast motion that supports the breasts without the appearance of wearing a bra.

The breast platform system offers women the comfort and peace of mind that they deserve. No longer will they be forced into the slavery and constraint of an uncomfortable bra.

The breast platform system eliminates concerns about breast support so that women can now enjoy the freedom and comfort of not always having to be strapped in and constrained by that uncomfortable bra.

BRIEF DESCRIPTION OF DRAWINGS

The drawings illustrate preferred embodiments of the breast platform system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

FIG. 3 is a sectional view of the breast platform system, the section taken through an L-shaped platform as indicated in FIG. 1.

FIG. 4 is a perspective view of an L-shaped platform showing slots in the vertical leg and holes through the horizontal leg.

FIG. 5 is a side elevation view of an L-shaped platform showing a spring hinge linking the legs, a cushion atop the horizontal leg and a passage for the strap.

FIG. 6 is a top view of a spring hinge.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
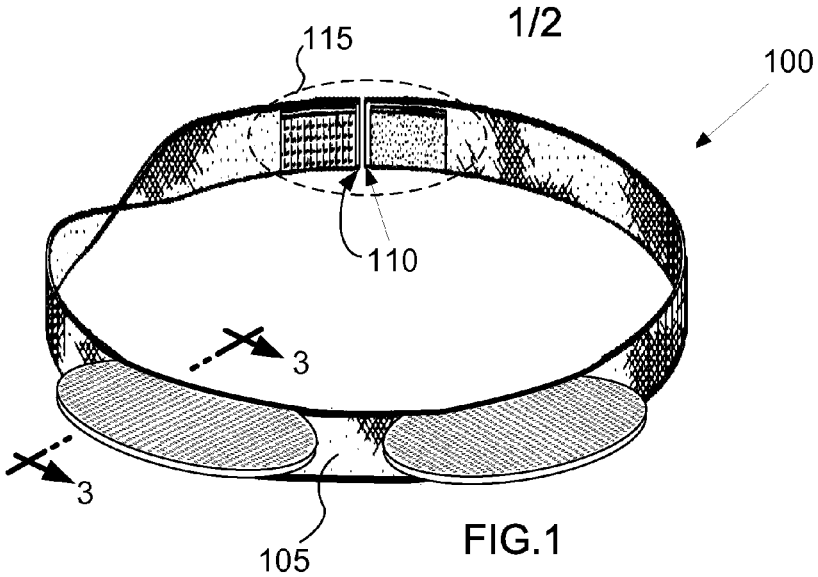
FIG. 1 is a perspective view of a preferred embodiment of the breast platform system.
Figure 2:
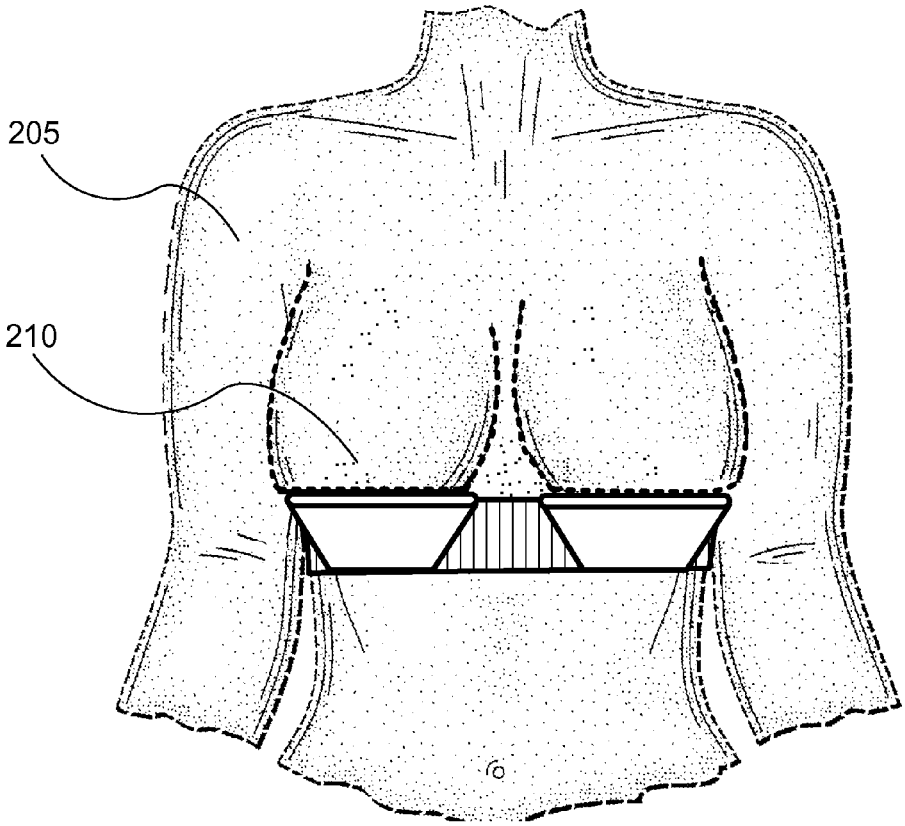
FIG. 2 is a front elevation view of the breast platform system in place on a female torso.

FIG. 1 illustrates in perspective a breast platform system (100) for a human body (205), the breast platform system (100). FIG. 2 illustrates the breast platform system (100) in place on a human body (205), which in FIG. 2 is exemplified by a female torso.

The breast platform system (100) includes an L-shaped platform (400), shown in FIG. 4, for each human breast (210). Each L-shaped platform (400) comprises a vertical leg (405) and a horizontal leg (410). The vertical leg (405) is configured to rest against the human body (205) under a human breast (210) and the horizontal leg (410) is configured to extend outward from the human body (205) under the human breast (210). These components may have a variety of shapes to accommodate the variety of breasts to be held aloft by the breast platform system (100).

There are several options that will make the breast platform system (100) more comfortable in use. A first is that the L-shaped platform (400) is preferably made of flexible, light weight plastic that bends or gives a little under the weight of a breast. A little give or closure of the angle between the horizontal leg (410) and the vertical leg (405) will make the breast platform system (100) more comfortable in use by enabling some downward motion of the breast, for example, while walking. Freedom of breast movement may be enhanced by adding a spring hinge (510), shown in FIG. 5 and FIG. 6. The spring hinge (510) joins the horizontal leg (410) to the vertical leg (405). The spring hinge (510) is configured for biasing the horizontal leg (410) to a horizontal position, and permits downward rotation of the horizontal leg (410) about the spring hinge (510). A clip, button or other securing device may be used to hold the horizontal leg (410) folded down and adjacent to the vertical leg (405) so that the breast is not held up by the horizontal leg (405).

A second option is a cushion (505) on the top surface of the horizontal leg (410) to soften the contact area for the breast. Thus, in an embodiment with the second option, a cushion (505) attached to the horizontal leg (410).

A third option is a contour to conform to the breast or torso. A horizontal-leg contour (305) is shown in FIG. 3, which shows is a sectional view of the breast platform system (100) where the section taken through an L-shaped platform as indicated by arrows 3-3 in FIG. 1. The vertical leg (405) may also be made with a contour to conform to the torso. The vertical leg (405) and a horizontal leg (410) may be joined at an obtuse angle, for example, so that the horizontal leg (410) tilts upward to better conform to the natural shape of the breast.

A fourth option involves providing a comfortable temperature by removal of body heat. In this embodiment, the horizontal leg (410) defines a plurality of holes (420) through the horizontal leg (410), which permits air flow and cooling of the breast.

The breast platform system (100) further includes a strap (105) that engages each L-shaped platform (400). The engagement may be in a variety of alternative ways of attachment. For example, the strap may slide through a passage (515) at the rear of the vertical leg (405), holding the vertical leg (405) in place simply by friction. A button, snap or other mechanical fixture may be used with the passage (515).

A second example of an engagement is encompassing the vertical leg (405) within the strap so that the vertical leg (405) is immovably fixed in position relative to the strap. Thus for this second example, each vertical leg (405) is embedded within the strap (105) so as to fix the position of each L-shaped platform (400) on the strap (105).

A third example of an engagement is a repositionable hook and loop (e.g., VELCRO) attachment between the vertical leg (405) and the strap (105).

A fourth example of an engagement is one where the strap is threaded through slots (415) in the vertical leg (405). Two or more of such slots may be used. In the embodiment comprising the fourth example, the L-shaped platform (400) defines slots (415) in the vertical leg (405) such that the strap (105) may be woven through the slots (415) and the position of the each L-shaped platform (400) can be adjusted by sliding the strap (105) through the slots (415). Other types of slidable, repositionable, and fixed engagements are possible.

In a preferred embodiment, the strap (105) has two free ends (110) that fit around the human body (205) and that can be joined together with a fastener (115), such as a hook, button or hook and loop (e.g., VELCRO) system. This arrangement is similar to known bra securing devices, may be located at any convenient location, such as the front of the strap (105) between the L-shaped platforms (400) or at the rear of the torso. Thus, in this embodiment, the strap (105) comprises a fastener (115) such that the two free ends (110) can be secured together so that the strap (105) fits around the human body (205) while holding each L-shaped platform (400) in position.

Alternatively, the strap (105) may simply be entirely elastic and positioned by sliding it over one's head into position, or stepping into it and sliding it up the torso.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the garment industry.

What is claimed is:

1. A breast platform system for a human body, the breast platform system comprising:

an L-shaped platform for each breast, each L-shaped platform comprising a vertical leg and a horizontal leg, wherein the vertical leg is configured to rest against the human body under a human breast and the horizontal leg is configured to extend outward from the human body under the human breast without covering the breast; and a strap engaging each L-shaped platform, the strap comprising an elastic material fitting around the human body while holding each L-shaped platform in position under the human breast.

2. The breast platform system of claim 1, wherein the strap comprises two free ends that fit around the human body, the strap further comprising a fastener such that the two free ends are securable together around the human body.

3. The breast platform system of claim 1, wherein each vertical leg is embedded within the strap so as to fix the position of each L-shaped platform on the strap.

4. The breast platform system of claim 1, wherein the L-shaped platform defines slots in the vertical leg such that the strap may be woven through the slots and the position of the each L-shaped platform can be adjusted by sliding the strap through the slots.

5. The breast platform system of claim 1, further comprising a cushion attached to the horizontal leg.

6. The breast platform system of claim 1, wherein the horizontal leg defines a plurality of holes therethrough.

7. The breast platform system of claim 1, further comprising a spring hinge:

joining the horizontal leg to the vertical leg;

biasing the horizontal leg to a horizontal position; and permitting downward rotation of the horizontal leg.

* * * * *